United States Patent [19]

Commins et al.

[11] Patent Number: 5,027,573

[45] Date of Patent: Jul. 2, 1991

[54] DECK CLIP SYSTEM, METHOD AND CONNECTOR CONNECTION

[75] Inventors: Alfred D. Commins, Danville; Tyrell T. Gilb, Berkeley, both of Calif.

[73] Assignee: Simpson Strong-Tie Company, Inc., San Leandro, Calif.

[21] Appl. No.: 484,031

[22] Filed: Feb. 22, 1990

Related U.S. Application Data

[63] Continuation-in-part of Ser. No. 345,908, May 1, 1989, abandoned.

[51] Int. Cl.[5] ..... E04B 9/00

[52] U.S. Cl. ..... 52/489; 52/509; 52/715; 52/480

[58] Field of Search ..... 52/489, 480, 509, 715

[56] References Cited

U.S. PATENT DOCUMENTS

| | | | |
|---|---|---|---|
| 3,187,389 | 6/1965 | Anderson | 20/92 |
| 4,127,975 | 12/1978 | Judkins | 52/489 |
| 4,299,069 | 11/1981 | Neumann | 52/309 |
| 4,333,286 | 6/1982 | Weinar | 52/281 |
| 4,377,060 | 3/1983 | Ragland | 52/489 |
| 4,448,007 | 5/1984 | Adams | 52/489 |
| 4,620,403 | 11/1986 | Field | 52/480 |

*Primary Examiner*—Richard E. Chilcot, Jr.
*Assistant Examiner*—Lan Mai
*Attorney, Agent, or Firm*—James R. Cypher

[57] ABSTRACT

An attachment system, method and connector connection for constructing a structure having supporting members and supported members as most commonly found in house and patio wood decks, board walks, stair systems, wood benches and trellis systems. The structures using the present disclosures are characterized by the apparent absence of nails or other fasteners. In fact, however, the structures are securely fastened by nails or screw fasteners in combination with a unique connector which uniquely is not directly connected to the supporting members.

In some forms of the invention, locator prongs are provided on the connector for assisting the installer to attach the connector to the supporting board member. In its broadest form, however, no prongs are needed on the connector.

In a preferred form of the connector, a projection is formed in the connector which bears against the underside of an adjacent structure even though the connector is not precisely installed.

7 Claims, 6 Drawing Sheets

1
2
4
5
6
7
8
9
11
12
13
15
16
17
18
19
20
22
24
25
27
30
31

DECK CLIP SYSTEM, METHOD AND CONNECTOR CONNECTION

This is a continuation-in-part of our co-pending application Ser. No. 07/345,908, filed May 1, 1989 now abandoned, entitled DECK CLIP SYSTEM, METHOD AND CONNECTOR CONNECTION.

BACKGROUND OF THE DISCLOSURE

This invention relates to a system for constructing a structure in which support members carry transverse members; the method of construction and the special metal clip used in the construction. Examples of such structures are house and patio decks, board walks, benches, stair treads, bench seating, trellis systems and other similar structures.

In constructing wood decks, for example the standard method is to nail directly through the deck boards into the supporting joist members. The problems associated with this method are well known and include: (1) nails backing out with seasonal swelling and shrinkage of the wood, (2) rusting of the nails and staining of the deck boards, (3) wood bruises of the deck boards by hammer marks, and (4) loosening of the boards due to nail pull out.

Field U.S. Pat. No. 4,620,403 provides an anchor which attempts to secure deck boards directly to the supporting joist members, but in practice the anchor has been unsuccessful due to loosening of the boards after the wood shrinks. The Field anchor in addition to being difficult to install, may result in uneven decks since the deck boards rest on top of a portion of the anchor instead of resting directly on the joist member.

SUMMARY OF THE INVENTION

The gist of the present invention is the use of a clip in a system and method for constructing a structure in which the clip is attached to an adjoining supported member between the supporting members rather than directly to the supported member. Thus, the supported members are connected directly to the supporting members without any clip interposed therebetween.

An object of the present invention is to construct a structure such as a deck using the present method in which there are no fasteners driven through the top surface of the supported deck boards; thus giving the initial appearance that there are no nails used in the construction of the structure.

Another object is to provide a structure in which there are no nails driven through the top surface of the supported deck boards, thus eliminating staining due to rusting nail heads.

A further object is to construct a structure in which all fasteners are driven into the wood so that all nail connections are in shear rather than in tension where failure is due to direct pull out of the nails.

A still further object is to provide a method of installation which is easy, fast and provides a relatively planar surface with ordinary diligence.

Still another object is to provide a system which will remain relatively secure through seasonal changes which normally cause shrinkage and swelling of the wood.

Another object is to provide a connector which will bear against the underside of the adjoining supported deck board even though the clip is not precisely installed.

Finally, an object is to provide a connector which automatically secures adjoining supported members while automatically spacing those members.

DESCRIPTION OF THE PREFERRED EMBODIMENTS

Figure 1:
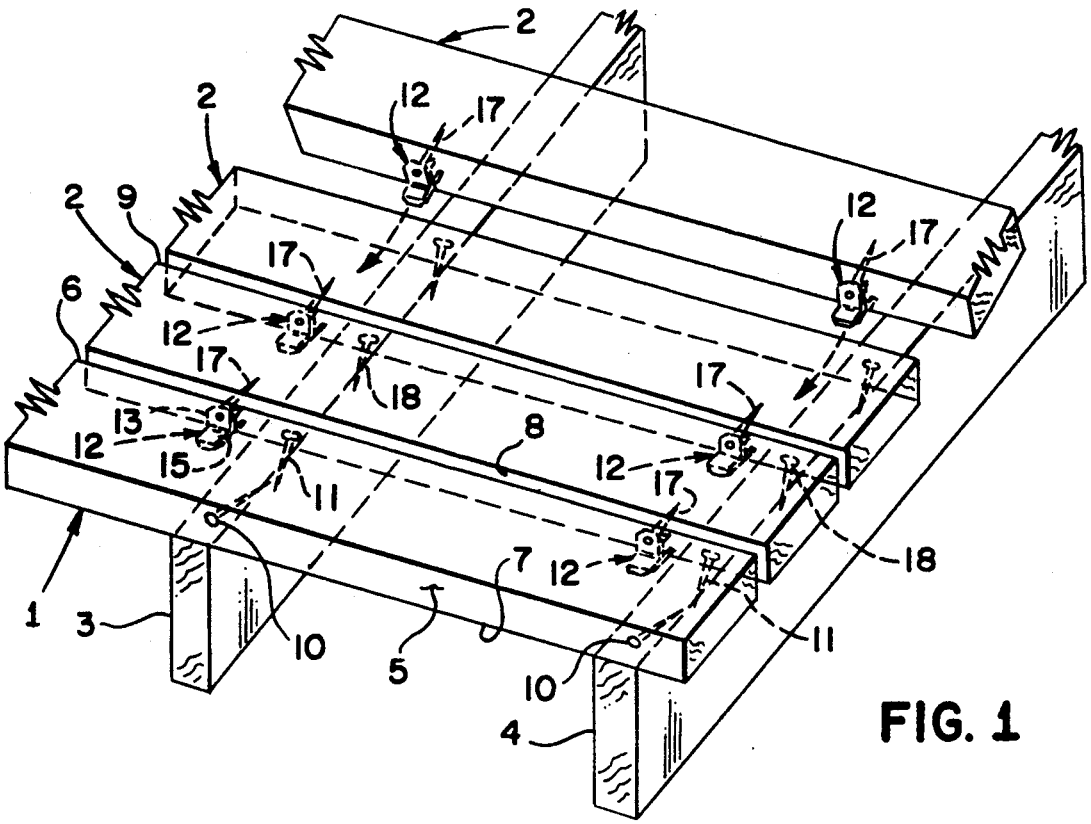
FIG. 1 is a perspective view of a portion of a construction illustrating the system, method and connection.

The attachment system of the present invention for installing a first supported board 1 and a plurality of generally parallel spaced adjoining supported boards 2 to at least two supporting members 3 and 4 positioned transversely to the supported boards consists briefly of a first supported board 1 having first and second side edges 5 and 6 and a bottom side 7; each of the adjoining supported boards 2 having a connector held edge 8 and a holding edge 9; means 10 and 11 affixing the first supported board 1 to the supporting members 3 and 4; a plurality of connectors 12 positioned at selected spaced intervals between the supporting members 3 and 4 and each having an upright member 13 formed with a fastener opening 14 with the upright member 13 positioned between the second side edge 6 of the first supported board 1 and the connector held edge 8 of the adjoining supported board 2 and a first flange member 15 connected to the upright member 13 at a generally right angle and positioned in registration with the bottom side 7 of the first supported board 1; a plurality of connector fasteners 17 each inserted through the fastener opening 14 in the upright member 13 into the connector held side edge 8 of the adjoining supported board 2; and means 18 affixing the holding edge 9 of the adjoining supported board 2 to the supporting members 3 and 4.

While a simple angle will be satisfactory for some installations, a preferred form of connector for the attachment system includes a second flange member 19 connected to the upright member 13 and positioned in registration with the bottom side 16 of the adjoining supported board member 2 and rigidifying means 20 connected to the first and second flange members 15 and 19. As illustrated in the drawings a preferred form is to have a third flange member 21 connected to the upright member 13 and positioned in registration with the bottom side 16 of the adjoining supported board member 2.

The rigidifying means may be an embossment but preferably a depending flange 22 is attached at one edge of flanges 19 and 15 and a second depending flange 23 is attached at the other edge of flanges 21 and 15.

A method of installing a first supported board 1 having first and second side edges 5 and 6 and a bottom side 7 and a plurality of generally parallel spaced adjoining supported boards 2 having a connector held edge 8 and a holding edge 9 to at least two supporting members 3 and 4 positioned transversely to the supported boards consists of: affixing the first supported board 1 to the supporting members 3 and 4; selecting a relatively rigid connector member 12 each having an upright member 13 and a flange member 15 connected to the upright member 13; affixing the upright member 13 of the relatively rigid connector 12 to the connector held edge 8 of the adjoining supported board 2; placing the adjoining supported board 2 in parallel relation to the first supported board 1 and inserting the flange member 15 of the relatively rigid connector 12 connected to the adjoining supported board 2 beneath the first supported board member 1 so that the upright member 13 of the relatively rigid connector 12 is in closely spaced relation to the second edge 6 of the first supported board 1 and the flange member 15 is in registration with the bottom side 7 of the first supported board 1; and joining the holding edge 9 of the adjoining supported board 2 to the supporting member 3.

In the preferred method of of installation the rigid connector member 12 selected includes a second flange member 19 connected to the upright member 13 positioned in registration with the bottom side 16 of the adjoining supported board member 2 and rigidifying means such as depending flange 22 connected to the first and second flange members 15 and 19.

Figure 2:
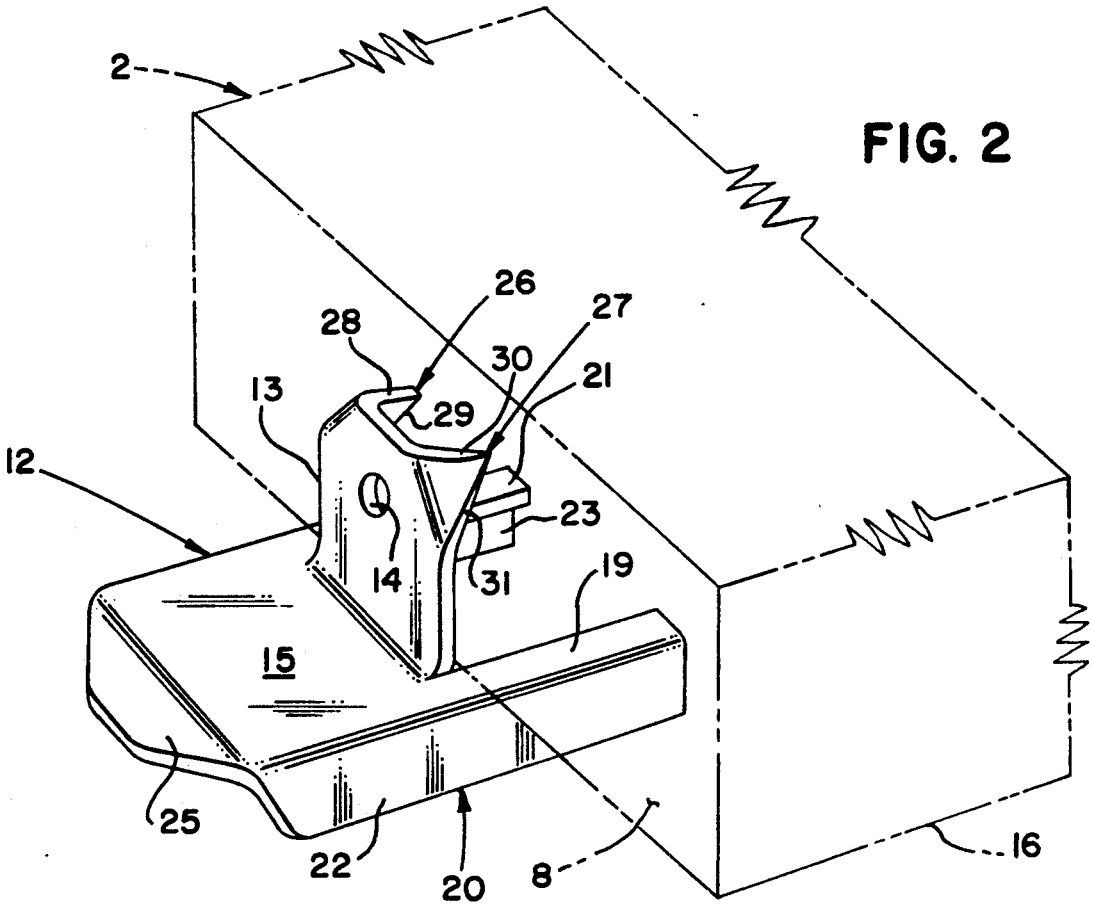
FIG. 2 is a perspective view of the connector of the present invention with a portion of a board shown in broken line.
Figure 3:
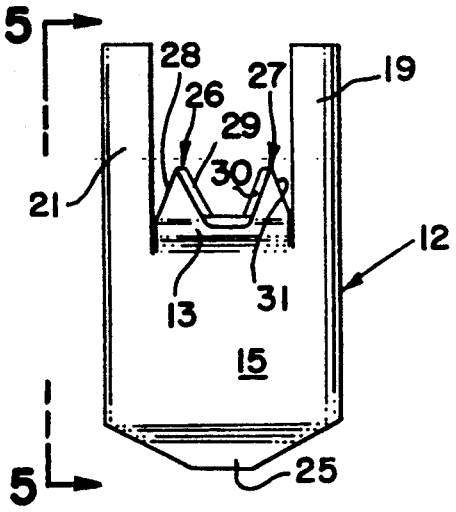
FIG. 3 is a top plan view of the connecter shown in FIG. 2.

Although a simple angle member may be used in the system and method of practicing the invention previously described, the preferred connector is illustrated in FIG. 2 and is used in a connection which comprises: a plurality of supporting members 3 and 4; a first supported board 1 positioned transversely on the supporting members 3 and 4 having first and second side edges 5 and 6 and a bottom side 7; an adjoining supported board 2 positioned transversely on the supporting members 3 and 4 generally parallel to the first supported board 1 and having a connector held edge 8, a holding edge 9, and a bottom side 16; means 10 and 11 affixing the first supported board 1 to the supporting members 3 and 4; a connector 12 positioned between the supporting members 3 and 4 having an upright member 13 formed with a fastener opening 14 with the upright member 13 positioned between the second side edge 6 of the first supported board 1 and the connector held edge 8 of the adjoining supported board 2 and a first flange member 15 connected to the upright member 13 at a generally right angle and positioned in registration with the bottom side 7 of the first supported board 1 and a second flange member 19 connected to the upright member 13 positioned in registration with the bottom side 16 of the adjoining supported board 2; a connector fastener 17 formed with a head member 24 inserted through the fastener opening 14 in the upright member 13 into the connector held side edge 8 of the adjoining supported board 2; and means such as nail 18 affixing the holding edge 9 of the adjoining supported board 2 to the supporting members 3 and 4.

As previously stated, the connector for the connection may be formed with a pair of rigidifying flange members such as depending flanges 22 and 23 connected to the first, second, and third flange members 15, 19, and 21.

The preferred method of installing adjoining supported boards 2 is to initially tilt them at an angle so that flange 15 will more easily slip underneath bottom side 7 of the first supported board 1 or a previously installed adjoining supported board 2. However, to prevent flange 15 from catching on a previously secured board, a nose member 25 is connected to or formed in the first flange member 15 and positioned at an angle to the first flange member 15 for facilitating insertion of the first flange member beneath the first supported board.

Figures 8, 9:
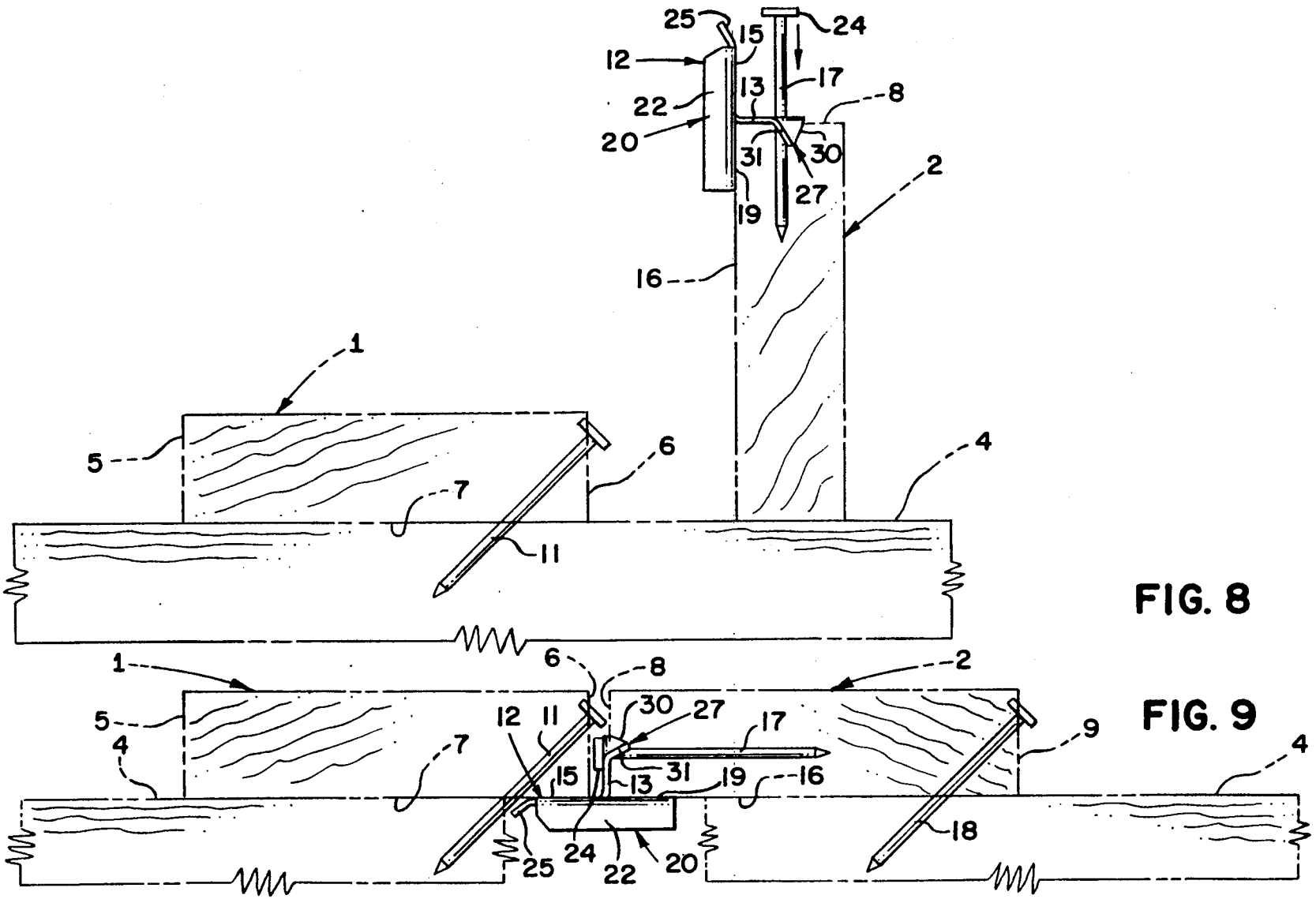
FIG. 8 is a side view of a portion of the construction illustrated in FIG. 1 illustrating the method of construction. Two boards and the supporting member are shown in broken line.
FIG. 9 is a side view of the construction shown in FIG. 8 further illustrating the method of construction.

To assist in attaching connector 12 to the connector held edge 8 while the adjoining supported board is on edge as shown in FIG. 8, a locator prong may be formed in upright member 13. This may be a single locator prong or preferably a pair of locator prongs 26 and 27 for insertion into the connector held edge 8 of the adjoining supported board 2.

Figure 5:
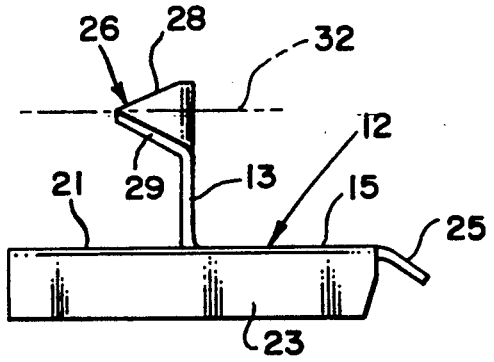
FIG. 5 is a side elevation view of the connector shown in FIG. 3 taken along line 5—5.
Figure 4:
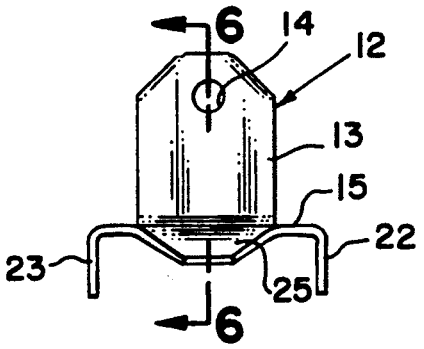
FIG. 4 is a front elevation view of the connector shown in FIG. 3.
Figure 6:
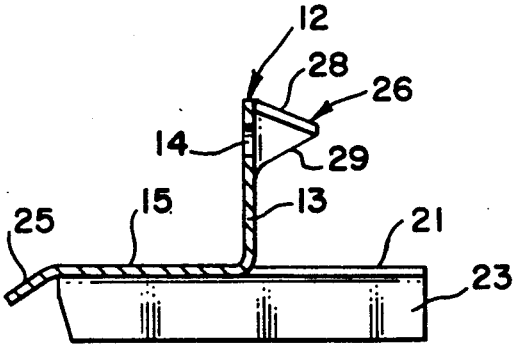
FIG. 6 is a sectional view of the connector shown in FIG. 4 taken along line 6—6.
Figure 7:
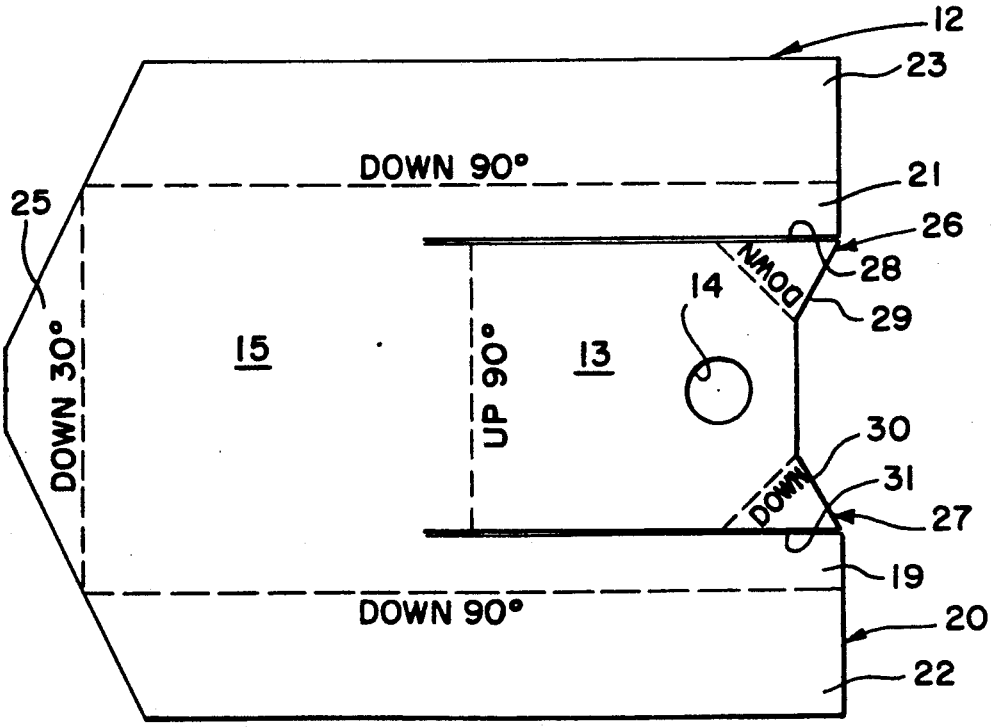
FIG. 7 is a plan view of the connector shown in FIG. 3 in the cutout blank form prior to bending.

The locator prongs may be formed so that the locator prong edges 28, 29, 30 and 31 are formed at equal angles which bisect an imaginary line 32 drawn through the point of the locator prong on an axis perpendicular to the plane of the upright member 13 as shown in FIG. 5. This way of forming the locator prongs causes the locator prongs to enter board 2 and remain on a straight line parallel to the plane of bottom side 16 of board 2.

Figure 12:
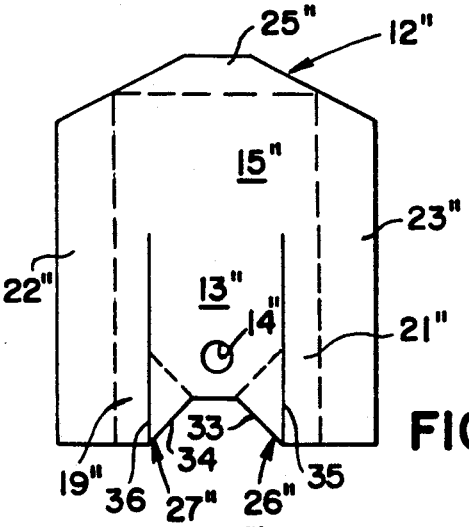
FIG. 12 is a plan view of another modified form of the invention shown in blank form prior to bending.
Figure 13:
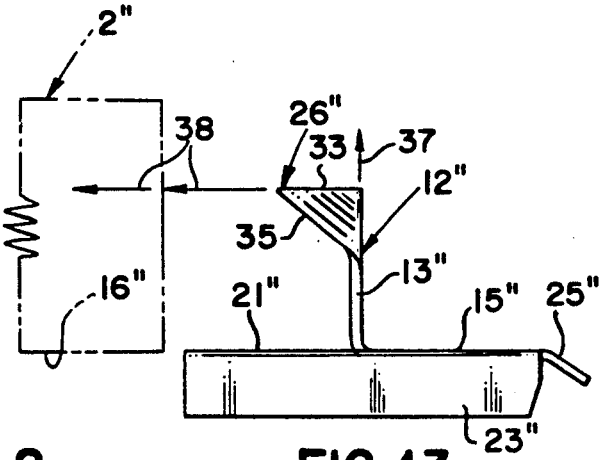
FIG. 13 is a side view of the modified form shown in FIG. 12 with a board in broken line.

A modified form of the invention is illustrated in FIGS. 12 and 13 in which the locator prong members 26″ and 27″ are formed with top edges 33 and 34 generally parallel to the first flange member 15″ and lower edges 35 and 36 disposed at an angle to the respective top edges 33 and 34 of locator prongs 26″ and 27″. Modified locator prong members 26″ and 27″ have the effect of moving the entire connector 12" in the direction of arrow 37 as the locator prongs 26" and 27" are driven by a hammer in the direction of arrows 38 thereby moving first flange member 15" into tight fitting relation to bottom side 16" of adjoining supported board 2". Lower edges 35 and 36 of locator prongs 26" and 27" have the effect of a wedge in moving connector 2" in the direction of arrow 37 as the connector moves in the direction of arrows 38. Except for the modifications noted immediately above, the connector 12" is in all respects identical to the connector previously described in FIGS. 1-9 and will not be further described. To assist in the understanding of the modified form, like or identical parts have been given the same numbers but with the addition of the double prime (") symbol.

Figure 14:
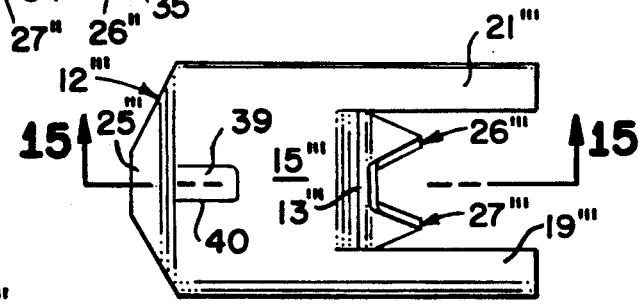
FIG. 14 is a top plan view of still another form of the invention.
Figure 15:
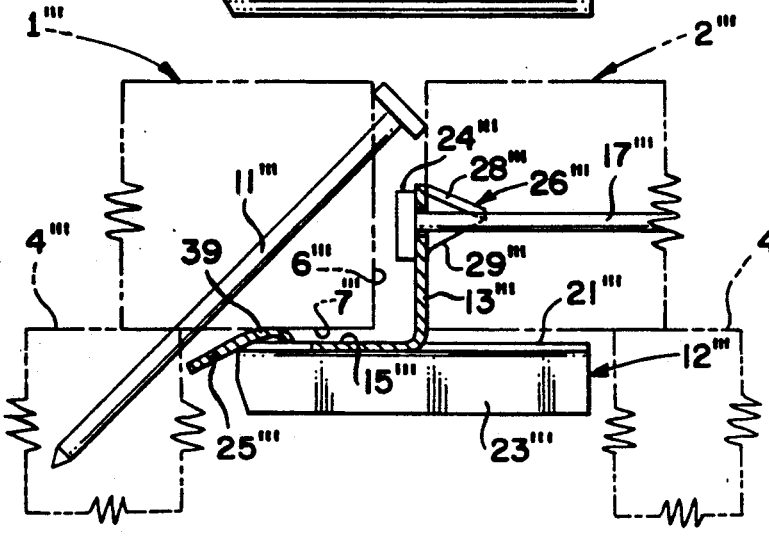
FIG. 15 is a sectional view of the form of the invention illustrated in FIG. 14 taken along line 15—15. Portions of board members and supporting members are shown in broken line.
Figure 16:
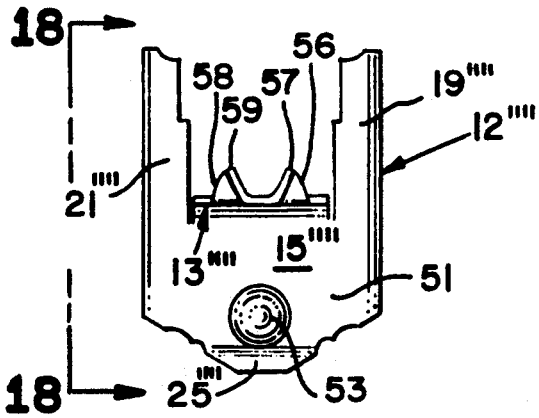
FIG. 16 is a top plan view of a still further modified form of the invention.
Figure 18:
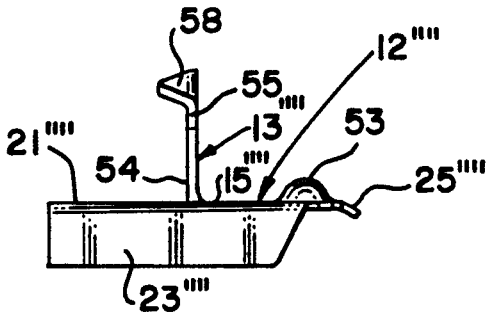
FIG. 18 is a side elevation view of the connector shown in FIG. 16 taken in the direction of line 18—18.
Figure 17:
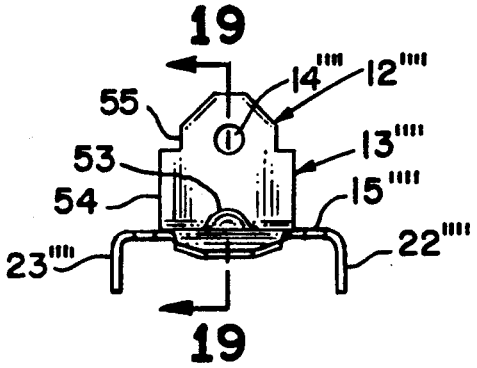
FIG. 17 is a front elevation view of the connector shown in FIG. 16.
Figure 19:
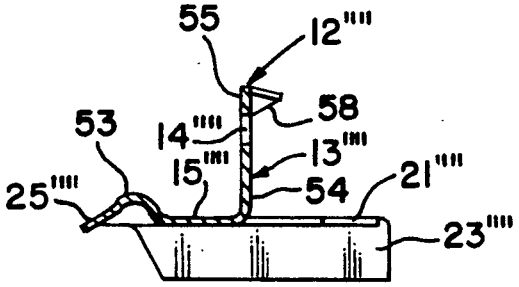
FIG. 19 is a sectional view of the connector shown in FIG. 17 taken along line 19—19.

Still another form of the invention is illustrated in FIGS. 14 and 15. In order to make a satisfactory connection in the present invention, flange member 15''' must be in close registration with bottom side 7''' of first supported board 1'''. In the event that the connector 12''' is erroneously connected so that there is a space between first flange 15''' and bottom side 7''' of board 1''' as shown in FIG. 15, a tight connection may be effected by forming a deformed tab member 39 in the first flange member 15''' so that the deformed tab is disposed above the first flange member for registration with the bottom side 7''' of the first supported board member 1'''. The deformed tab 39 may be formed by slitting first flange 15''' along cut line 40, forcing the tab upwardly and bending the tab with a radius curve as shown in FIG. 15. Except for the modifications noted immediately above, the connector 12''' is in all respects identical to the connector previously described in FIGS. 1-9 and will not be further described. To assist in the understanding of the modified form, like or identical parts have been given the same numbers but with the addition of the triple prime (''') symbol.

Figure 10:
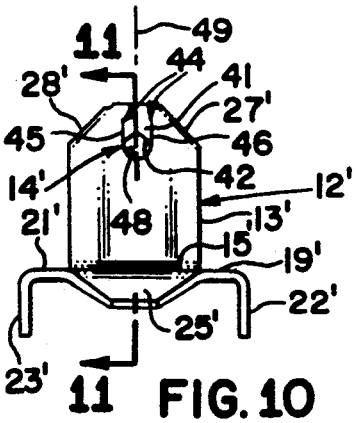
FIG. 10 is a front elevation view of a modified form of the invention.
Figure 11:
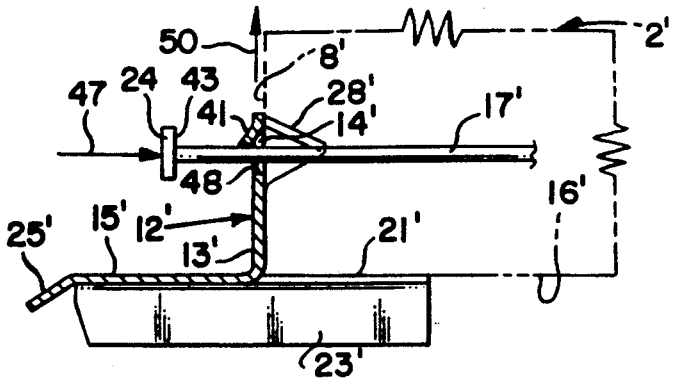
FIG. 11 is a sectional view of the modified form shown in FIG. 10, taken along line 11—11 and in conjunction with a board in broken line.

Still another form of the invention is illustrated in FIGS. 10 and 11. As previously explained, to provide a good connection, it is necessary to install each connector 12' so that flange 15' is in close registration with the bottom side 7 of the first supported board 1 and all adjoining supported boards 2'. In order to provide this necessary close registration, a snugging tab member 41 is formed in the upright member 13' adjacent the fastener opening 14' for engaging the head member 24 of the connector fastener 17 for causing the second flange 19' as well as a third flange 21', where one is provided on the connector 12', to move into close fitting engagement with the bottom side of the adjoining supported board 2'. As in the previously described connectors, locator prongs 27' and 28' may or may not be provided. Except for the modifications noted immediately above, the connector 12' is in all respects identical to the connector previously described in FIGS. 1-9 and will not be further described. To assist in the understanding of the modified form, like or identical parts have been given the same numbers but with the addition of the single prime (') symbol.

The specific operation of the snugging tab 41 is as follows: First, where the connector is provided with locator prongs, these locator prongs 27' and 28' are either pressed or lightly tapped into connector held edge 8' of adjoining supported board 2' until the upright member 13' is nearly against or actually against connector held edge 8' of adjoining supported board 2' as illustrated in FIG. 11. Care must be taken not to flatten snug tab 41 when the locator prongs are being driven into the wood.

The second step is to place a fastener, such as nail 17 through opening 14' so that the shank of the nail 17 is in close contact with the end 42 of snug tab 41. Preferably, the end 42 of snug tab 41 is formed as a semi-circular curve with the radius generally the same as that of the shank of fastener 17 as shown in FIG. 10. Until head 24 of fastener 17 reaches snug tab 41, there is no upward movement of the connector 12' relative to the adjoining supported board 2'. As soon, however, as the underside edge 43 of fastener head 24 engages snug tab 41, it draws the snug tab 41 toward connector held edge 8' with the snug tab rotating about a line which corresponds generally to the ends of the slits 45 and 46 which form the snug tab 41 and generally indicated by the arrows 44. Since the fastener 17 at this point in time is fixed in relation to adjoining supported board 2, movement of fastener 17 in the direction of arrow 47 causes upright member 13' to move upwardly in the direction of arrow 50 and any flange such as flanges 21' and 19' are drawn up into engagement with the bottom side 16' of adjoining supported board 2'. Upon the completion of the procedure, the upper side of the shank of fastener 17 will remain in engagement with end 42 of snug tab 41 and the lower side of the shank of fastener 17 will be near or in engagement with the lowermost edge 48 of opening 14'. It is to be understood that prior to installation of the connector 12', opening 14' is generally elongated along the long axis 49 of snug tab 41, and after installation and the bending of the snug tab, opening 14' is generally circular so as to securely grip the shank of the fastener 17.

Examples of types of construction where the system, method and connection disclosed may be used are as follows. The most typical example is in the construction of decks for homes which are either attached to the home or may be free standing decks. These decks may be either elevated several feet above the ground or built just a few inches above the ground. The support members 3 and 4 in decks and patios would be characterized as joist members and the first supported board 1 would be designated the first deck board. Decks and patios are commonly constructed from red wood when available, or treated woods to protect them from water and sun. Joist members are commonly 2×6's, 2×8, 2×10's or 2×12's depending upon the loads to be carried by the decks. Deck board members are commonly 1¼ nominal size with an actual size of 1" in thickness, but may also be 1½" actual size. The connector disclosed may be used without change in dimensions for all of the sizes just mentioned, and further it may be used with virtually any size decking with only slight dimensional but no structural shape changes.

Stairs are often attached to patio decks, and the same system, method and connector connection may be used in constructing the stairs. In this case, the support members 3 and 4 would be designated as stair stringers and the supported boards 1 and 2 would be the treads and/or stair risers. Construction of a stairs using the present system would be obvious and is not repeated.

Still another use of the system, method and connector connection disclosed would be in the construction of wood benches. Often benches are built as a part of the railing of patio decks. The "no-nail" theme of the present invention could be thus carried through the deck, stairs and railing type benches making one unitary architectural statement. The supporting members 3 and 4 would support seat and back boards which would correspond to the boards 2 and 3 of the present disclosure. Again, construction of a bench using the present system, method and connector connection would be obvious and is not repeated.

Other constructions using the present system, method and connector connection would include board walks, trellis systems and other structures where it is a design requirement that no nails be conspicuous.

A common theme that runs throughout the types of structures where the connector of the present disclosure may be used is the uniform separation of the supported members from one another. This necessarily results from the thickness of the upright member 13 and the thickness of the fastener head 24. Since uniform spacing is desired in decks, board walks, benches and other such structures, the upright member serves the dual function of being the primary attachment member as well as serving as an automatic spacing element.

The disclosure is suitable for use by the "do it yourselfer" for week end projects as well as by professional builders and architects.

The connectors should preferably be affixed along the supported boards at intervals of about 12" or between each set of supporting members. Where the supporting members are spaced at intervals greater than 12", it may be desirable to affix the connectors at closer intervals. FIG. 1 illustrates the standard method of installation with all connectors attached to the connector held edge 8 of the adjoining supported boards 2. In some installations, it may be desirable to install additional connectors 12 by also affixing connectors to the holding edge 9 of the adjoining supported boards 2. This would place first flange 15 in registration with the bottom side 16 of adjoining supported boards 2 and second and third flanges 19 and 21 in registration with the bottom side 7 of the first supported board 1. Where such an additional connector 2 was installed with upright member 13 in registration with holding edge 9, first flange 15 would be in registration with the bottom side 16 of adjoining supported board 2 and second and third flanges 19 and 21 would be in registration with the bottom side 16 of the next adjacent supported board 2.

A number of alternate means may be employed in attaching the supported boards directly to the supporting members. The most common system is illustrated in the drawings in which means 10 and 11 are nails which are toe-nailed through edges 5 and 6 of first supported board 1 and means 18 are nails driven through edge 9 of adjoining supported boards 2. Instead of toe-nailing the supported boards may be attached by means of straps or ties.

The preferred form of the invention is illustrated in FIGS. 16–22. The connection consists of a plurality of supporting members 4'''', a first supported board 1'''' positioned transversely on the supporting members 4'''' having first and second side edges 5'''' and 6'''' and a bottom side 7'''', an adjoining supported board 2'''' positioned transversely on the supporting members 4'''' generally parallel to the first supported board 1'''' and having a connector held edge 8'''', a holding edge 9'''', and a bottom side 16'''', means 11'''' such as a nail affixing the first supported board 1'''' to the supporting members 4'''', a connector 12'''' positioned only between the supporting members 4'''' having an upright member 13'''' formed with a fastener opening 14'''' with the upright member 13'''' positioned between the second side edge 6'''' of the first supported board 1'''' and the connector held edge 8'''' of the adjoining supported board 2'''' and a first flange member 15'''' connected to the upright member 13'''' at a generally right angle and positioned in registration with the bottom side 7'''' of the first supported board 1'''' and having a front portion 51 and a second flange member 19'''' connected to the upright member 13'''' positioned in registration with the bottom side 16'''' of the adjoining supported board 2'''', a connector fastener 17'''' formed with a head member 24'''' inserted through fastener opening 14'''' in upright member 13'''' only into connector held side edge 8'''' of adjoining supported board 2'''', means 18'''' affixing holding edge 9'''' of adjoining supported board 2'''' to supporting members 4'''', and a projection member 53 formed in front portion 51 of first flange member 15'''' of connector 12'''' projecting in the same direction as upright member 13'''' for registration with bottom side 7'''' of first supported board 1''''.

Figure 20:
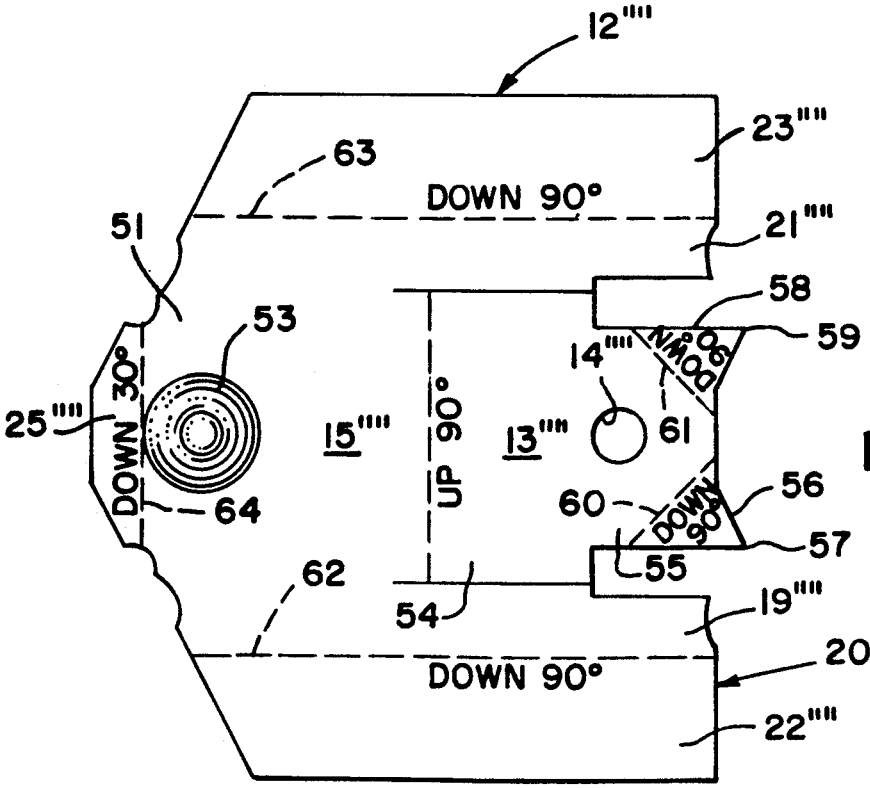
FIG. 20 is a plan view of the connector shown in FIG. 16 in the cutout blank form prior to bending.
Figure 21:
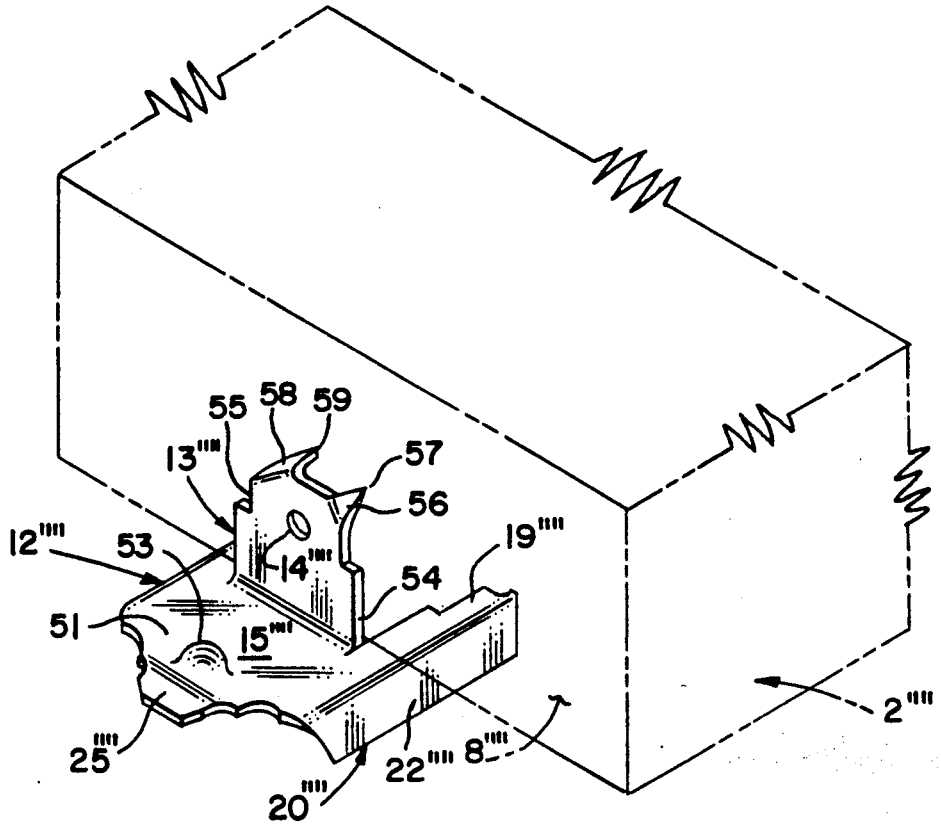
FIG. 21 is a perspective view of the connector illustrated in FIGS. 16–20 with a portion of a board shown in broken line.

Preferably, the projection member 53 formed in front portion 51 of first flange member 15'''' of connector 12'''' consists of a dome shaped member. Upright member 13'''' of connector 12'''' is formed with a lower end 54 and an upper end 55 and upper end 55 has a width less than the lower end 54'. A locator prong 56 may be formed in upper end 55 of upright member 13'''' of connector 12'''' positioned at right angles to upright member 13'''' and having a sharpened end 57 directed for insertion into connector held side edge 8'''' of adjoining supported board 2''''. As shown in the drawings there may be an additional locator prong 58 with a sharpened point 59. As illustrated in FIG. 20, prongs 56 and 58 may be constructed by bending along bend lines 60 and 61. Depending flange 22'''' and second depending flange 23'''' are constructed by bending 90° along bend lines 62 and 63.

Other parts in the modified form illustrated in FIGS. 16–22 which are similar to parts in the forms of the invention previously described are numbered but not further described for purposes of brevity.

To facilitate installation, a narrow nose member 25'''' is formed at front portion 51 at bent down at about a 30° angle along bend line 64.

Figure 22:
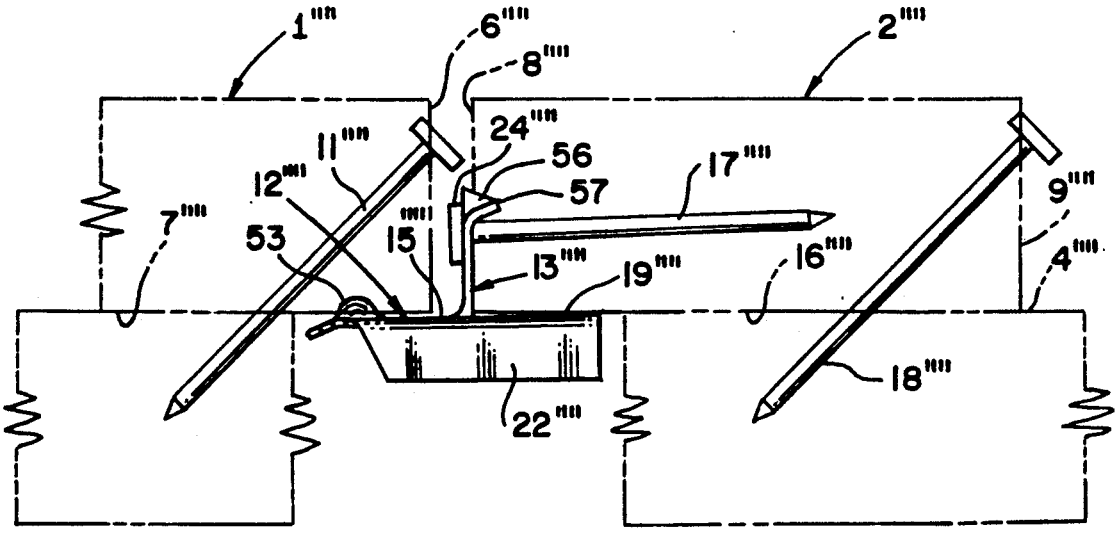
FIG. 22 is a side view of the connector illustrated in FIGS. 16–21 showing the installation of the connector when it is not precisely installed. Portions of two adjoining supported deck boards and a portion of a supporting joist member are shown in phantom line.

Installation of connector 12'''' is illustrated in FIG. 22. To insure that connector 12'''' is as snugly in registration as possible with the bottom faces 7'''' and 16'''' of deck boards 1'''' and 2'', it is recommended that nail 17'''' be driven into connector held side edge 8'''' at an upward angle. As in the common carpentry practice of toe-nailing, this will draw flanges 15'''' and 19'''' up against the underside of the boards.

Even with the practice of slanting nail 17'''' upwardly, because of swelling and contraction of the deck boards due to the cycling of heat and cold and drying and wetting, it is important that projection member 53 be provided and bear against the underside face 7'''' of deck board 1'''' to prevent prevent connector held side edge 8'''' of deck board 2'''' from curling upwardly and presenting an uneven deck surface or permitting the boards to be loose. This is essential because in the present application, connector held side edge 8'''' is not otherwise connected to the underlying supporting joist members 4''''. Only connector 12'''' bearing against the underside of the secured edge 6'''' of board 1'''' prevents the unsecured edge 8'''' of board 2'''' from lifting.

We claim:

1. An attachment system for installing a first supported board and a plurality of generally parallel spaced adjoining supported boards to at least two supporting members positioned transversely to said supported boards comprising:

a. said first supported board having first and second side edges and a bottom side;

b. each of said adjoining supported boards having a connector held edge and a holding edge;

c. means affixing said first supported board to said supporting members;

d. a plurality of connectors positioned only at selected spaced intervals between said supporting members and each having an upright member formed with a fastener opening position at a first selected position, with said upright member positioned between said second side edge of said first supported board and said connector held side edge of said adjoining supported board and a first flange member connected to said upright member at a generally right angle at a second selected position distant from said fastener opening at said first selected position and positioned in registration with said bottom side of said first board;

e. a plurality of connector fasteners each inserted through said fastener opening in said upright member only into said connector held side edge of said adjoining supported board;

f. each of said connectors includes a second flange member positioned generally the same distance from said fastener opening as said first flange member and connected to said upright member at a generally right angle and adapted for registration with said bottom side of said adjoining supported board member;

g. spring rigidifying means connected to said first and second flange members;

h. a portion of said first flange member is raised above said first flange member to a third position closer to said fastener opening than said first and second flange members and adapted for registration with said bottom side of said said first supported board so as to cause said first and second flange members to be in spring tension; and i. fastener means affixing said holding edge of said adjoining supported board to said supporting members.

2. A connection as described in claim 1 comprising:

a. said rigidifying means includes a pair of rigidifying flange members connected to and for cooperating spring tension with said first and second flange members.

3. A connection as described in claim 1 comprising a. a nose member connected to said first flange member positioned at an angle to said first flange member for facilitating insertion of said first flange member beneath said first supported board and stiffening said first flange member.

4. A connection as described in claim 3 comprising:

a. a locator prong member connected to said upright member for insertion into said connector held edge of said adjoining supported board.

5. A connection as described in claim 4 comprising:

a. said locator prong member is formed with a top edge generally parallel to said first flange member and a lower edge disposed at an angle to said top edge of said prong.

6. A connection as described in claim 5 wherein:

a. said raised portion of said first flange member formed in said front portion of said first flange member of said connector consists of a dome shaped member;

b. said upright member of said connector is formed with a lower edge and an upper end and said upper end having a width less than said lower end; and c. a locator prong formed in said upper end of said upright member of said connector positioned at a right angle to said upright member and having a sharpened end directed for insertion into said connector held side edge of said adjoining supported board.

7. A connection comprising:

a. plurality of supporting members;

b. a first supported board positioned transversely on said supporting members having first and second side edges and a bottom side;

c. an adjoining supported board positioned transversely on said supporting members generally parallel to said first supported board and having a connector held edge, a holding edge, and a bottom side;

d. means affixing said first supported board to said supporting members;

e. a connector positioned only between said supporting members having an upright member formed with a fastener opening with said upright member positioned between said second side edge of said first supported board and said connector held edge of said adjoining supported board and a first flange member connected to said upright member at a generally right angle and positioned in registration with said bottom side of said first supported board and a second flange member connected to said upright member positioned in registration with said bottom side of said adjoining supported board;

f. a connector fastener formed with a head member inserted through said fastener opening in said upright member only into said connector held side edge of said adjoining supported board;

g. means affixing said holding edge of said adjoining supported board to said supporting members;

h. a pair of rigidifying flange members connected to said first and second flange members;

i. a nose member connected to said first flange member positioned at an angle to said first flange member for facilitating insertion of said first flange member beneath said first supported board;

j. a locator prong member connected to said upright member for insertion into said connector held edge of said adjoining supported board;

k. said locator prong member is formed with a top edge generally parallel to said first flange member and a lower edge disposed at an angle to said top edge of said prong;

l. a deformed tab member connected to said first flange member disposed above said first flange member for registration with the bottom side of said first supported board member; and m. a snugging tab member formed in said upright member adjacent said fastener opening for engaging said head member of said connector fastener for causing said second flange of said connector to move into close fitting engagement with said bottom side of said adjoining supported board.

* * * * *